US006660687B2

(12) United States Patent
Bodmer et al.

(10) Patent No.: US 6,660,687 B2
(45) Date of Patent: Dec. 9, 2003

(54) CF SHEETS

(75) Inventors: Jerome Robert Bodmer, Appleton, WI (US); David Paul Kendall, Appleton, WI (US); Jason David Long, Black Creek, WI (US); Lester Alfred Balster, Appleton, WI (US)

(73) Assignee: Appleton Papers Inc., Appleton, WI (US)

( * ) Notice: Subject to any disclaimer, the term of this patent is extended or adjusted under 35 U.S.C. 154(b) by 82 days.

(21) Appl. No.: 09/824,669

(22) Filed: Apr. 4, 2001

(65) Prior Publication Data

US 2003/0022789 A1 Jan. 30, 2003

(51) Int. Cl.[7] ..... B41M 5/20
(52) U.S. Cl. ..... 503/200; 427/150
(58) Field of Search ..... 427/150; 503/200

(56) References Cited

U.S. PATENT DOCUMENTS

| | | | | |
|---|---|---|---|---|
| 3,649,357 A | * | 3/1972 | Davis et al. | |
| 4,339,275 A | | 7/1982 | Tutty | 524/255 |
| 4,354,449 A | | 10/1982 | Zink | 118/126 |
| 4,755,501 A | | 7/1988 | Chang et al. | 503/207 |
| 5,231,117 A | | 7/1993 | Seitz | 523/161 |

* cited by examiner

*Primary Examiner*—B. Hamilton Hess
(74) *Attorney, Agent, or Firm*—Birch, Stewart, Kolasch & Birch, LLP

(57) ABSTRACT

A carbonless copy assembly made up of at least one CB sheet and one CF sheet, the CF sheet having a color developer resin coating of less than 0.39 pounds per ream. A process for making the carbonless copy paper assembly comprising the steps of: spraying a composition containing resin capable of developing microencapsulated dyes onto a base sheet to form a CF sheet, and combining that CF sheet with a CB sheet to form the carbonless copy paper assembly.

11 Claims, 2 Drawing Sheets

CF SHEETS

FIELD OF THE INVENTION

This invention relates to the field of carbonless copy paper. Carbonless copy paper technology is an outgrowth of the historic technology in which, for instance, a sheet of paper coated with a removable carbon-containing substance was interleaved with two sheets of ordinary paper for the purpose of copying onto the second sheet of ordinary paper text or other writings as it was in the process of being inscribed on the first sheet of ordinary paper. In carbonless copy paper technology, the separate sheet of carbon-coated paper is replaced by reactive materials located on the two (or more) sheets of paper which are destined to bear the original and copied writings.

BACKGROUND OF THE INVENTION

Carbonless copy paper assemblies generally employ two (or more) sheets of paper. In a two-sheet embodiment, the bottom side of the top sheet is coated with a coating that contains encapsulated dyes dissolved in oil. This surface is known as the CB (coated back) surface. The top side of the bottom sheet is coated with a coating that contains components which are reactive with respect to the dyes in the CB surface. This surface is know as the CF (coated front) surface. The CF sheet is generally manufactured by applying the appropriate coating to a paper substrate by such conventional techniques as air knife, rod, blade, and roll coating.

A typical embodiment of two-sheet carbonless copy paper is the forms that are signed in connection with credit card purchases. When the capsules are ruptured by force (e.g., the force of a ball point pen), the oils containing the reactive dyes are transferred to the CF surface and an image (e.g., of a signature) results. This technology is well known.

The dyes and oils in the capsules coated on the CB sheet are quite costly, relative to the other components of the carbonless copy paper products.

SUMMARY OF THE INVENTION

The present invention provides for improved transfer of the oils and dyes from the CB surface to the CF surface. In accordance with the present invention, the active ingredients of the CF surface are more available to the CB dyes due to improvements in the micro-structure of the CF surface. Thus, one embodiment of the present invention is a carbonless copy paper assembly comprising at least one CB sheet and one CF sheet, in which the CF sheet has a pore diameter distribution characterized by a pore diameter volume under curve of at least 0.15 mL/g.

The improvements in the micro-structure of the CF surface enable increased efficiency of the oil transfer mechanism, which means that the costly reactive components of the CF sheet can provide an acceptable level of copying at lower concentrations. In accordance with the present invention, therefore, a carbonless copy paper assembly having a desired copying efficiency can be produced more economically than comparable assemblies produced by prior art processes. Thus, another embodiment of the present invention is a carbonless copy paper assembly comprising at least one CB sheet and one CF sheet, in which the CF sheet has a color developer resin coating of less than 0.39 pounds per ream, for instance about 0.35 pounds per ream and even as low as from 0.06 to 0.22 pounds per ream.

Especially preferred color developer resins for use in the present invention are acetylated phenolic resins, salicylic acid modified phenolics, and novolac type phenolic resins.

Yet another embodiment of the present invention is a process for making a carbonless copy paper assembly. This process comprises the steps of spraying a composition containing resin capable of developing microencapsulated dyes onto paper to form a CF sheet, e.g. at a rate of about 25% solids with 4.2% resin to provide a coating of about 0.35 pounds per ream, and combining the spray-coated CF sheet with a CB sheet to form the carbonless copy paper assembly. Finally, this invention also includes the spray-coated CF sheets as made by that process.

DETAILED DESCRIPTION OF THE INVENTION

Figure 1:
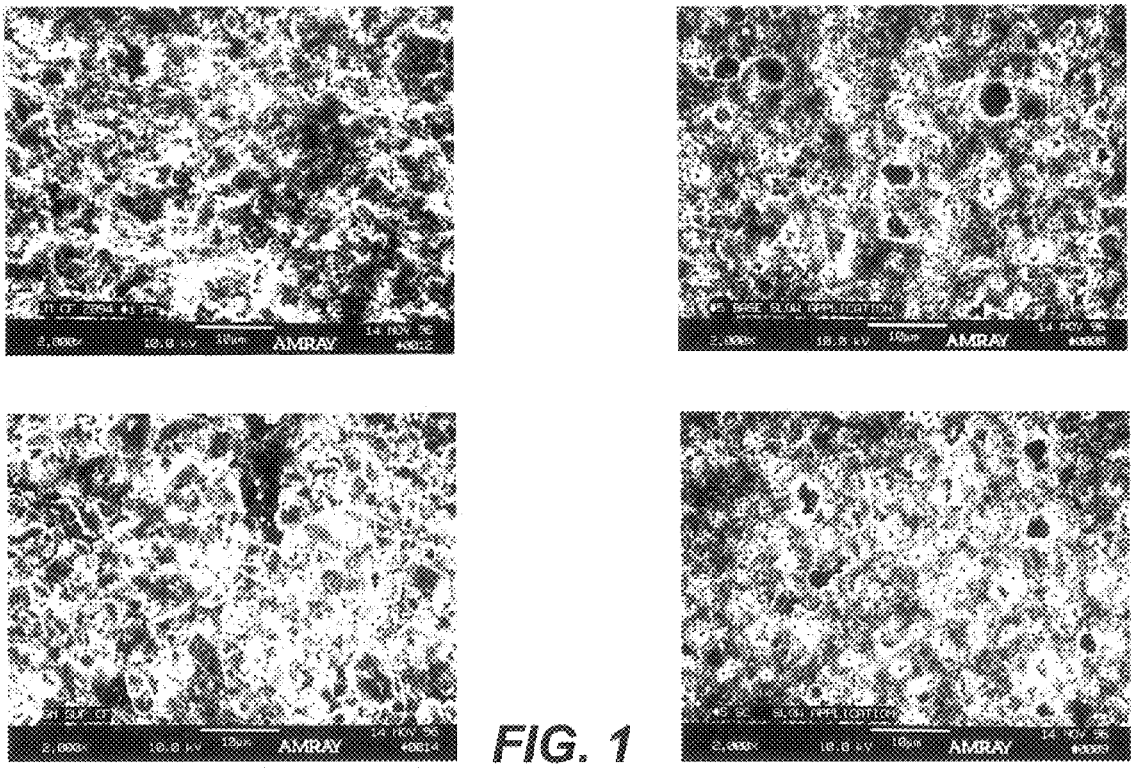
FIG. 1 consists of SEM photographs comparing porosity of CF sheets of the present invention with porosity of analogous CF sheets made by conventional procedures.

Carbonless copy papers are manufactured by providing a layer of pressure-rupturable microcapsules containing solutions of colorless dyestuff precursor on the back side of the front sheet of paper of a carbonless copy paper assembly. In order to develop an image or copy, this CB paper must be mated with a paper containing a coating of a suitable color developer, also known as a dyestuff acceptor, on its front.

The references to "paper" in this application should be understood as extending to any suitable paper-like base sheet, including for instance CF sheets comprising phenolic resin and clay filler.

The color developer in this CF paper is generally an acidic material capable of forming the color of the dyestuff by reaction with the dyestuff precursor. Examples of suitable acidic developer material include: clays; treated clays (U.S. Pat. Nos. 3,622,364 and 3,753,761); aromatic carboxylic acids such as salicylic acid; derivatives of aromatic carboxylic acids and metal salts thereof (U.S. Pat. No. 4,022,936); phenolic developers (U.S. Pat. Nos. 3,244,550 and 4,573,063); acidic polymeric material such as phenol-formaldehyde polymers (U.S. Pat. Nos. 3,455,721 and 3,672,935); and metal-modified phenolic resins (U.S. Pat. Nos. 3,732,120; 3,737,410; 4,165,102; 4,165,103; 4,166,644 and 4,188,456). Thus, among the well-known and preferred color developers used on CF record sheets are phenolic-type resins, such as acetylated phenolic resins, salicylic acid modified phenolics, and novolac type phenolic resins.

Among the well known basic, colorless, chromogenic dye precursors useful for developing colored marks when and where applied to a receiving sheeted coated with such color developers are Crystal Violet Lactone, Benzoyl Leuco Methylene Blue, Indolyl Red, Malachite Green Lactone, and Rhodamine Lactone. More details on color developable compositions can be found in U.S. Pat. Nos. 4,755,501 and 4,339,275.

Examples of color formers useful in CB sheets include 3,3-bis(4-dimethylaminophenyl)-6-dimethylaminophthalide (U.S. Pat. No. Re. 23,024); 3,3-bis(4-diethylaminophenyl)-6-dimethylaminophthalide; phenyl-, indol-, pyrrol-, and carbazol-substituted phthalides (U.S. Pat. Nos. 3,491,111;

3,491,112; 3,491,116; and 3,509,174); nitro-, amino-, amido-, sulfonamido-, aminobenzylidene-, halo-, anilino-substituted fluorans (for example, in U.S. Pat. Nos. 3,624,107; 3,627,787; 3,641,011; 3,642,828; and 3,681,390); spirodipyrans (U.S. Pat. No. 3,971,808); and pyridine and pyrazine compounds (U.S. Pat. Nos. 3,775,424 and 3,853,869). Other suitable chromogenic compounds include: 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)-fluoran; 3-dibutylamino-7-(2-chloroanilino)-fluoran; 3-(N-ethyl-N-tetrahydrofurfurylamino)-6-methyl-7-[3,5', 6-tris(dimethylamino)]spiro [9H-fluorene-9,1'(3'H)-isobenzofuran]-3'-one; 7-(1-ethyl-2-methylindol-3-yl)-7-(4-diethylamino-2-ethoxyphenyl)-5,7-dihydrofuro[3,4-b] pyridin-5-one (U.S. Pat. No. 4,246,318); 3-diethylamino-7-(2-chloroanilino)-fluoran (U.S. Pat. No. 3,920,510); 3-(N-methylcyclohexylamino)-6-methyl-7-anilino-fluoran (U.S. Pat. No. 3,959,571); 7-(1-octyl-2-methylindol-3-yl)-7-(4-diethylamino-2-ethoxyphenyl)-5,7-dihydrofuro[3,4-b] pyridin-5-one; 3-diethlamino-7,8-benzofluoran; 3,3-bis(1-ethyl-2-methylindol-3-yl)phthalide; 3-diethylamino-7-dibenzylamino-2,2'-spiro-di-[2H-1-benzopyran]; and mixtures of any of the foregoing.

U.S. Pat. No. 5,231,117, the entire disclosure of which is hereby incorporated by reference, teaches a CB sheet which produces a black image. The dye precursors used include a mixture of leuco dyes in relative proportions such that when reacted with a color developer an intense black image is produced. A useful black dye precursor composition includes 23% Pergascript I-GD Green, 14.5% Copiken XX Red, 6% Copiken I Blue, and 56.5% Pergascript I-BR Black.

Microcapsules

Microcapsules are employed to contain the chromogenic dyestuff color precursor, also known as the color former. The color former may be contained, for instance, within microcapsules comprising synthetic resin such as those taught by the polymerization method of U.S. Pat. No. 4,552,811, incorporated herein by reference. A preferred microcapsule internal phase is:

| 1. Material | Parts Dry |
|---|---|
| 3.3-bis(p-dimethylaminophenyl-6-dimethylaminophthalide (Crystal Violet Lactone) | 2.00 |
| 3,3-bis(1-octyl-2-methylindol-3-yl)phthalide | 0.60 |
| 3-diethylamino-6-methyl-7-(2'4-dimethylanilino) fluoran (U.S. Pat. No. 4,330,473) | 0.30 |
| sec-butylbiphenyl (U.S. Pat. No. 4,287,074) | 63.12 |
| $C_{11}$–$C_{15}$ aliphatic hydrocarbon | 33.98 |

Processes of microencapsulation are now well-known in the art. U.S. Pat. No. 2,730,456 describes a method for capsule formation. Other useful methods for microcapsule manufacture may be found in: U.S. Pat. Nos. 4,001,140; 4,081,376; and 4,089,802, describing a reaction between urea and formaldehyde; U.S. Pat. No. 4,100,103, describing reaction between melamine and formaldehyde; British Patent No. 2,062,570, describing a process for producing microcapsules having walls produced by polymerization of melamine and formaldehyde in the presence of a styrene-sulfonic acid. Microcapsules in a self-contained system are taught in U.S. Pat. Nos. 2,730,457 and 4,197,346. In a self-contained system, microcapsules containing a chromogenic material solution and an acid developer material are coated on the same surface of a sheet of paper. Pressure exerted by writing or typing causes the capsules to rupture and release the chromogenic material, which then reacts with co-reactant on the sheet to produce color. The more preferred processes for forming microcapsules are made from urea-formaldehyde resin and/or melamine formaldehyde resin as disclosed in U.S. Pat. Nos. 4,001,140; 4,081,376; 4,089,802; 4,100,103; 4,105,823; 4,444,699; and 4,552,811.

A liquid solvent is conventionally employed in the microcapsules and can be any material which has sufficient solubility for the color former material, which is liquid within the temperature range at which carbonless copy paper is normally used and which does not suppress or otherwise adversely affect the color-forming reaction. Examples of suitable liquids include those solvents conventionally used for carbonless copy paper, such as ethyldiphenylmethane (U.S. Pat. No. 3,996,405); benzylxylenes (U.S. Pat. No. 4,130,299); alkylbiphenyls such as propylbiphenyl (U.S. Pat. Nos. 3,627,581 and butylbiphenyl (U.S. Pat. No. 4,287,074); dialkylphthalates in which the alkyl groups thereof have from 4 to 13 carbon atoms, e.g., dibutyl phthalate dioctylphthalate, dinonylphthalate, and ditridecylphthalate; 2,2,4-trimethyl-1,3-pentanediol diisobutyrate (U.S. Pat. No. 4,027,065); $C_{10}$–$C_{14}$ alkyl benzenes such as dodecyl benzene; alkyl or aralkyl benzoates such as benzyl benzoate; alkylated naphthalenes such as dipropylnaphthalene (U.S. Pat. No. 3,806,463); partially hydrogenated terphenyls; high-boiling straight or branched chain hydrocarbons; vegetable oils; animal oils; esterified vegetable oils; and mixtures of the foregoing.

The CB generally comprises a microcapsule containing an internal phase of chromogenic dyestuff precursor dissolved or dispersed in solvent. It is conventionally coated into the CB record sheets in the form of an aqueous slurry such as the following:

| i. Material | Parts Dry |
|---|---|
| Microcapsules | 73.6 |
| Cornstarch | 6.3 |
| Wheat starch | 17.4 |
| Soybean protein binder | 0.7 |

Production

In a typical manufacturing process according to the present invention, a roll of paper is continuously unwound past a spray coating station at a uniform speed. At a spray coating station, multiple spray heads apply the highly reactive and absorptive elements of the CF coating in a uniform matter. Good CF functionals are obtained with a 24% solids CF coating containing 4.5% resin, at a rate of approximately 0.220 pounds of resin per ream (3300 sq. ft.). This corresponds to approximately 4.5 pounds total weight of coating per ream Where a two-sheet carbonless copy paper assembly is to be manufactured, the back side of the top sheet is CB and the top side of the bottom sheet is CF. Where, however, three or more sheets will comprise part of the assembly, the middle sheet(s) will be coated on both the front—with a color developer composition—and on the back—with a dye precursor composition. U.S. Pat. No. 4,354,449, the entire disclosure of which is incorporated herein by reference, teaches how to coat a web of paper on opposite sides with different coating materials.

Properties

The process of the present invention provides a CF sheet having improved porosity by comparison to a similar sheet manufactured with a conventional coating technique. Improved porosity is demonstrated graphically by SEM (Scanning Electron Microscope) photography and quantitatively by Mercury porosimetry.

SEM Photographs

In FIG. 1, frames #0012 and #0014 show the pore structures of CF sheets coated with conventional blade coating technology. Frames #0008 and #0009 show the pore structures of CF sheets coated with spray technology in accordance with the present invention. It can be seen that the CF sheets of this invention are characterized by a number of relatively large, clearly defined pores, which are not found in the conventional CF sheets. Moreover, the microstructures of the novel CF sheets are devoid of the large, irregularly shaped gaps that appear in the conventional CF sheets.

Figure 2:
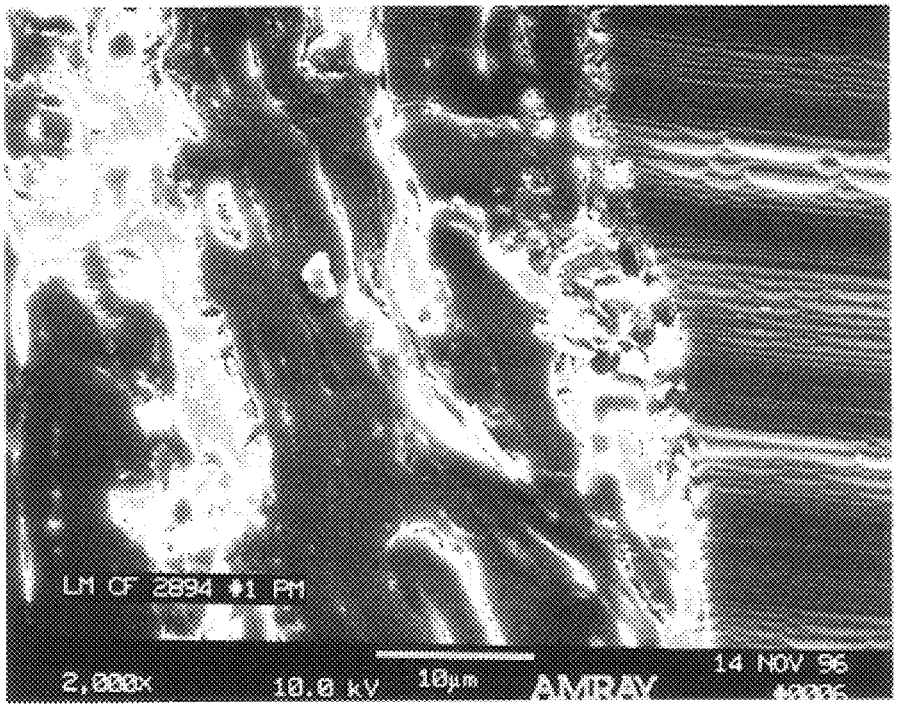
In FIG. 2 consists of SEM photographs showing cross-sectional views contrasting how a sprayed on coating of the present invention and a conventional CF coating lay on top of a sheet.
Figure 2:
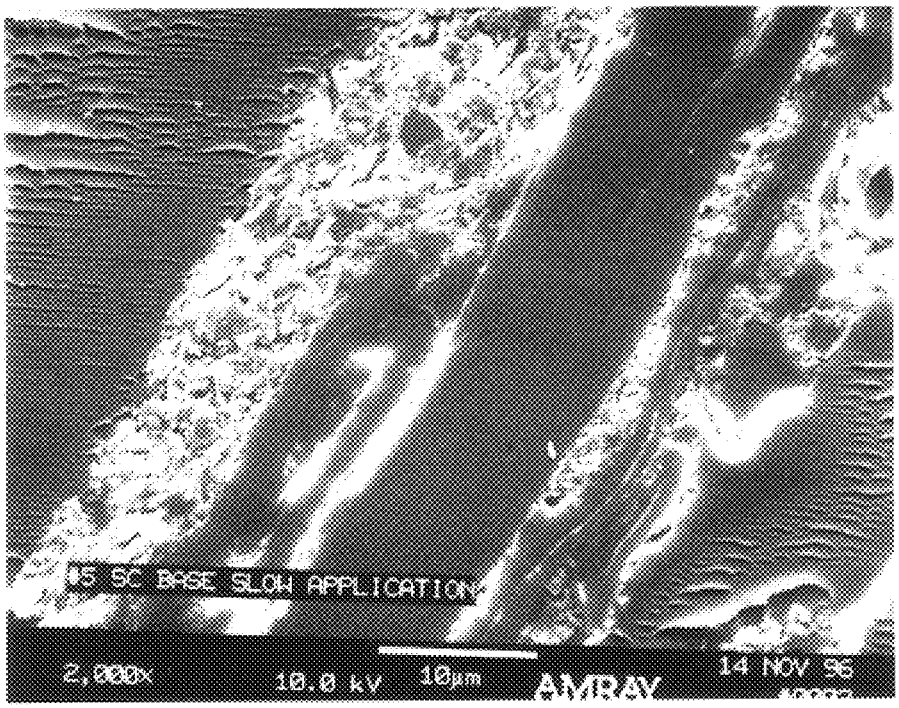

In FIG. 2, frame #0006 (LM CF 2894 #1 PM) shows a CF sheet coated with conventional blade coating technology. Frame #0003 (#5 SC BASE SLOW APPPLICATION) shows a CF sheet coated with spray technology in accordance with the present invention. These cross-sectional views show how the sprayed on coating of the present invention lays on top of the sheet in a markedly different manner than does the coating applied in a conventional manner in the conventional CF sheet.

Mercury Porosimetry

Pore diameter distribution, pore volume distribution, and pore diameter volume under curve are determined by standard test methods. Typical procedures that utilize mercury intrusion pososimetry for determining these parameters are described in American Society for Testing and Materials (ASTM) Publications D 4284-92 (1992) and D 4404-84 (1984, reapproved 1998). The entire disclosure of each of these publications is hereby incorporated by reference in its entirety.

Mercury porosimetry analysis was conducted on two embodiments of the present invention (identified as 6B and 6BSC) and four embodiments representative of conventional CF sheets (identified as 195, V1, V2, and V12). Base sheets of phenolic resin and clay filler were used. Sheets 195, V1, V2, and V12 are were coated at 0.65 pounds per ream with a coating at 20% solids with 8.4% resin. Sheets 6B and 6BSC were coated at 0.35 pounds per ream with a coating of 25% solids with 4.2% resin. The results are depicted in Table I:

TABLE I

| | 195 | V1 | V2 | V12 | 6B | 6BSC |
|---|---|---|---|---|---|---|
| Pore diameter at peak, $\mu$m | 10.39 | 16.53 | 16.54 | 10.39 | 4.54 | 10.39 |
| Volume under curve, mL/g | 0.1144 | 0.0727 | 0.0489 | 0.1264 | 0.1572 | 0.1829 |

Samples 6B and 6BSC have pore diameter distributions which are significantly broader than those of the conventional samples. This pore diameter distribution pattern is believed to contribute to the increased efficiency obtained with the CF sheets of the present invention.

EXAMPLES

Tables II*a* and II*b* demonstrate that print speed intensities, measured on an opacimeter, were surprisingly as intense or more intense than those of conventional CF when experimental samples were spray-coated in accordance with the present invention. The lower the value, the higher is the print speed intensity. Remarkably, these similar intensities were achieved using resin coated weights that were reduced in active resin by about 50 to 76% in terms of the number of pounds of resin applied per ream.

TABLE IIa

| Sample | Phenolic coating | Pounds/ ream | Print Speed Intensity 30 sec. | 60 sec. | 2 min. | 25 hrs. |
|---|---|---|---|---|---|---|
| Conventional | 20% solids, 13% resin | .65 | 45.0 | 44.0 | 43.6 | 41.8 |
| 12 | 25% solids, 10% resin | .38 | 46.3 | 45.5 | 45.3 | 41.6 |
| 3 | 25% solids, 10% resin | .35 | 38.7 | 38.1 | 38.0 | 36.4 |

TABLE IIb

| Sample | Phenolic coating | Pounds/ ream | Print Speed Intensity 30 sec. | 60 sec. | 2 min. | 25 hrs. |
|---|---|---|---|---|---|---|
| Conventional | 20% solids, 13% resin | .65 | 42.9 | 42.2 | 41.8 | 40.1 |
| 7 | 25% solids, 10% resin | .22 | 40.7 | 40.3 | 40.0 | 37.9 |
| 8 | 25% solids, 10% resin | .15 | 42.6 | 41.9 | 41.4 | 39.2 |

Several variations of this invention with alternative levels of binder to reduce ink holdout (tracking) and improve intensity were made. Also, a CF subcoat with a less expensive clay filler was evaluated to determine the impact of subcoat vs. spray coating on print properties. Print rolls were produced targeting 3.5 pounds/ream subcoat and 1.0 pound/ream topcoat spray coating. It was found that the sprayed topcoat has a negligible impact on print performance.

Tables III and IV summarize tests of a conventionally produced CF sheet and of six sheets produced according to the present invention.

In Tables III and IV:

Sheet 72 had no resin subcoat (NRS) and a control CF spray.

Sheet 73 had NRS and a reverse binder spray.

Sheet 74 had NRS and a 2% binder reduction spray.

Sheet 75 had NRS and a 4% binder reduction spray.

Sheet 76 had NRS and a 6% binder reduction spray.

Sheet 77 had a clay subcoat and a control CF spray.

TABLE III

| Print speed | 30 sec. | 60 sec. | 2 min. | 24 hr. |
|---|---|---|---|---|
| conventional | 42.6 | 41.8 | 41.5 | 39.0 |
| 72 | 55.5 | 55.3 | 55.4 | 50.9 |
| 73 | 63.9 | 63.7 | 63.6 | 60.3 |
| 74 | 63.9 | 64.2 | 64.0 | 60.3 |
| 75 | 63.6 | 64.2 | 64.1 | 61.2 |
| 76 | 49.0 | 48.9 | 48.6 | 46.2 |
| 77 | 79.3 | 79.3 | 79.2 | 74.7 |

TABLE IV

| | CF Coating Weight (# Resin/Ream) | FRICTIONAL SMUDGE |
|---|---|---|
| conventional | 0.465 | 86 |
| 72 | 0.157 | 90 |
| 73 | 0.090 | 90 |

TABLE IV-continued

| | CF Coating Weight (# Resin/Ream) | FRICTIONAL SMUDGE |
|---|---|---|
| 74 | 0.093 | 90 |
| 75 | 0.077 | 90 |
| 76 | 0.126 | 89 |
| 77 | 0.061 | 90 |

The present invention has been described and illustrated with reference to specific embodiments. Those skilled in the art will readily conceive of alternative embodiments that will enjoy the benefits of the invention disclosed herein.

Incorporation by Reference

Each of the disclosures of each of the following U.S. Pat. Nos.

2,730,456 3,624,107 3,806,463 4,081,376 4,246,318
2,730,457 3,627,581 3,853,869 4,089,802 4,287,074
3,244,550 3,627,787 3,861,390 4,100,103 4,339,275
3,368,390 3,641,011 3,920,510 4,105,823 4,354,449
3,455,721 3,642,828 3,959,571 4,130,299 4,444,699
3,491,111 3,672,935 3,971,808 4,165,102 4,510,513
3,491,112 3,732,120 3,996,405 4,165,103 4,552,811
3,491,116 3,737,410 4,001,140 4,166,644 4,573,063
3,509,174 3,753,761 4,022,936 4,188,456 4,755,501
3,622,364 3,775,424 4,027,065 4,197,346 5,231,117 as well as each of the disclosures of U.S. Pat. No. Re. 23,024 and British Patent No. 2,062,570 is incorporated into the present patent application in its entirety.

What is claimed is:

1. A carbonless copy paper assembly comprising at least one CB sheet and one CF sheet, in which the CF sheet has a color developer resin coating of less than 0.39 pound per 3300 sguare foot ream, wherein said CF sheet has a pore diameter distribution characterized by a pore diameter volume under curve of at least 0.15 ml.

2. The carbonless copy paper assembly of claim 1, in which the CF sheet is coated with about 0.35 pound per 3300 square foot ream of said color developer resin.

3. The carbonless copy paper assembly of claim 1, in which the CF sheet is coated with from 0.06 to 0.22 pound per 3300 square foot ream of said color developer resin.

4. The carbonless copy paper assembly of claim 1, wherein said resin comprises a member selected from the group consisting of acetylated phenolic resins, salicylic acid modified phenolics, and novolac type phenolic resins.

5. The carbonless copy paper assembly of claim 4, wherein said resin is applied at about 25% solids with about 4.2% resin.

6. The carbonless copy paper assembly of claim 1, wherein said CF sheet comprises phenolic resin and clay filler.

7. A process for making a carbonless copy paper assembly comprising the steps of:

spraying a composition containing resin capable of developing microencapsulated dyes onto a base sheet to form a CF sheet having a pore diameter distribution characterized by a pore diameter volume under curve of at least 0.15 mL, and combining said CF sheet with a CB sheet to form said carbonless copy paper assembly.

8. The process of claim 7, which comprises spraying the color developer resin at about 25% solids with 4.2% resin to a coating load of 0.35 pound per ream onto a base sheet comprising phenolic resin and clay filler.

9. The product of the process of claim 7.

10. The product of the process of claim 8.

11. A carbonless copy paper assembly comprising at least one CB sheet and one CF sheet, in which the CF sheet has a color developer resin coating of less than 0.39 pound per 3300 square foot ream, wherein said CF sheet is constructed by spraying a composition containing resin capable of developing microencapsulated dyes onto a base sheet to form said CF sheet with a pore diameter distribution characterized by a pore diameter volume under curve of at least 0.15 mL.

* * * * *